US006983502B2

(12) United States Patent
Boyd

(10) Patent No.: US 6,983,502 B2
(45) Date of Patent: Jan. 10, 2006

(54) AIR MATTRESS WITH PILLOW TOP

(75) Inventor: Dennis Boyd, Chesterfield, MO (US)

(73) Assignee: Boyd Flotation, Inc., Maryland Heights, MO (US)

( * ) Notice: Subject to any disclaimer, the term of this patent is extended or adjusted under 35 U.S.C. 154(b) by 0 days.

(21) Appl. No.: 09/821,932

(22) Filed: Mar. 30, 2001

(65) Prior Publication Data

US 2002/0138909 A1 Oct. 3, 2002

(51) Int. Cl.
*A47C 27/08* (2006.01)

(52) U.S. Cl. ..... 5/706; 5/655.3; 5/710

(58) Field of Classification Search ..... 5/706, 5/711, 712, 713, 724, 932, 710, 644, 655.3
See application file for complete search history.

(56) References Cited

U.S. PATENT DOCUMENTS

| | | | | | |
|---|---|---|---|---|---|
| 2,604,641 | A * | 7/1952 | Reed | 5/710 |
| 3,251,075 | A | 5/1966 | Saltness et al. | 5/337 |
| 3,879,776 | A * | 4/1975 | Solen | 5/665 |
| 4,896,389 | A | 1/1990 | Chamberland | 5/453 |
| 5,044,030 | A * | 9/1991 | Balaton | 5/710 |
| 5,072,469 | A | 12/1991 | Boyd | 5/451 |
| 5,107,557 | A | 4/1992 | Boyd | 5/451 |
| 5,115,526 | A | 5/1992 | Boyd | 5/451 |
| 5,423,094 | A * | 6/1995 | Arsenault et al. | 5/655.3 |
| 5,490,295 | A | 2/1996 | Boyd | 5/451 |
| 5,493,742 | A * | 2/1996 | Klearman | 5/423 |
| 5,566,408 | A * | 10/1996 | McCarthy et al. | 5/682 |
| 5,598,593 | A * | 2/1997 | Wolfe | 5/710 |
| 5,638,565 | A * | 6/1997 | Pekar | 5/710 |
| 5,647,078 | A * | 7/1997 | Pekar | 5/706 |
| 5,647,079 | A * | 7/1997 | Hakamiun et al. | 5/713 |
| 5,727,270 | A * | 3/1998 | Cope et al. | 141/114 |
| 5,740,573 | A * | 4/1998 | Boyd | 5/685 |
| 5,890,245 | A * | 4/1999 | Klearman et al. | 5/714 |
| 6,073,291 | A * | 6/2000 | Davis | 414/676 |
| 6,148,461 | A * | 11/2000 | Cook et al. | 5/713 |
| 6,332,760 | B1 * | 12/2001 | Chung | 417/239 |
| 6,568,011 | B2 * | 5/2003 | Fisher et al. | 5/706 |
| 6,618,884 | B1 * | 9/2003 | Wu | 5/706 |

* cited by examiner

*Primary Examiner*—Jack W. Lavinder
(74) *Attorney, Agent, or Firm*—Husch & Eppenberger, LLC; Gregory E. Upchurch

(57) ABSTRACT

An air mattress includes a first inflatable compartment having a length and width, when inflated, sufficient to support a human body. The first compartment having a top, a bottom, and sides and is composed of at least two layers of vinyl, one layer of vinyl forming the top of the compartment and the second forming the bottom. A second inflatable compartment is disposed on the top of the first inflatable compartment and is secured to the first compartment along a portion of the first inflatable compartment. The second compartment extends generally the length and width of the top of the first compartment and is of a size, when inflated, sufficient to support a human body. The second compartment is composed of at least two layers of vinyl distinct from the two layers of vinyl forming the first compartment. The second compartment is inflatable to give the top of the air mattress a soft, pillow-like appearance and feel.

3 Claims, 3 Drawing Sheets

AIR MATTRESS WITH PILLOW TOP

CROSS REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

This invention relates generally to air mattresses and more particularly to a air mattress with an second inflatable layer on top to provide a "pillow top" appearance and feel to the mattress.

The standard air mattress also could be improved in appearance and feel. The single vinyl top sheet of these mattresses is rather typically plain and flat in appearance, even with a pattern embossed thereon. Conventional mattresses, on the other hand, traditionally have a tufted or quilted appearance which people find attractive.

Moreover, conventional mattresses often have a different feel to the user than that achieved with conventional air mattresses. Such mattresses could be more acceptable with a better feel.

SUMMARY OF THE INVENTION

Among the various features of the present invention may be noted the provision of an air mattress in which the comfort is improved.

Another feature is the provision of such a air mattress with an improved appearance.

A third feature is the provision of such a air mattress with increased versatility.

Other objects and features will be in part apparent and in part pointed out hereinafter.

Briefly, in its broadest aspect an air mattress of the present invention includes a first inflatable compartment having a length and width, when inflated, sufficient to support a human body. The first compartment has a top, a bottom, and sides and is composed of at least two layers of vinyl, one layer of vinyl forming the top of the compartment and the second forming the bottom. The mattress also includes a second inflatable compartment disposed on the top of the first inflatable compartment and secured thereto at least along a portion of the first inflatable compartment. The second compartment extends generally the length and width of the top of the first compartment and is of a size, when inflated, sufficient to support a human body. The second compartment is composed of at least two layers of vinyl distinct from the two layers of vinyl forming the first compartment and is inflatable to give the top of the air mattress a soft, pillow-like appearance and feel.

DESCRIPTION OF THE PREFERRED EMBODIMENT

Figure 1:
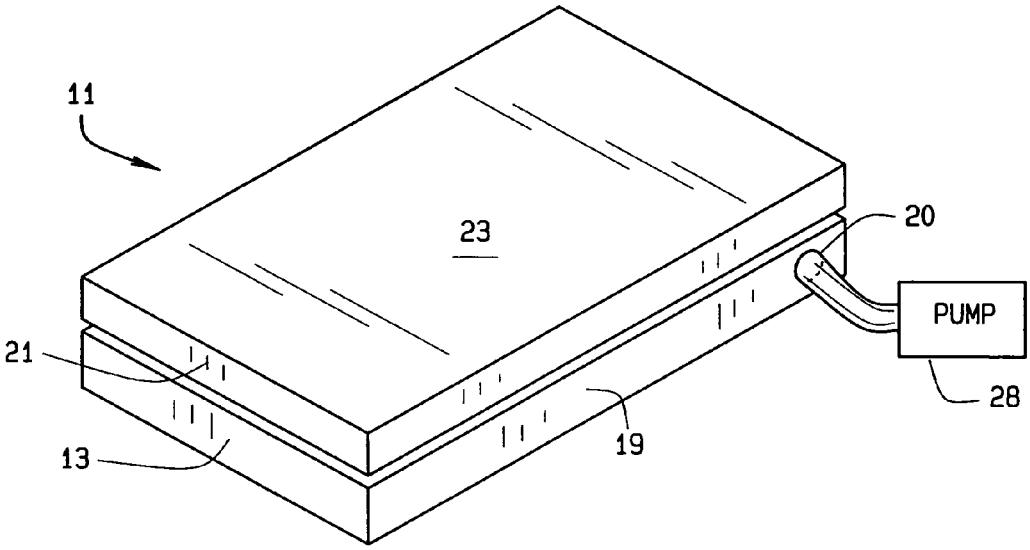
FIG. 1 is a perspective view illustrating the air mattress of the present invention.
Figure 2:
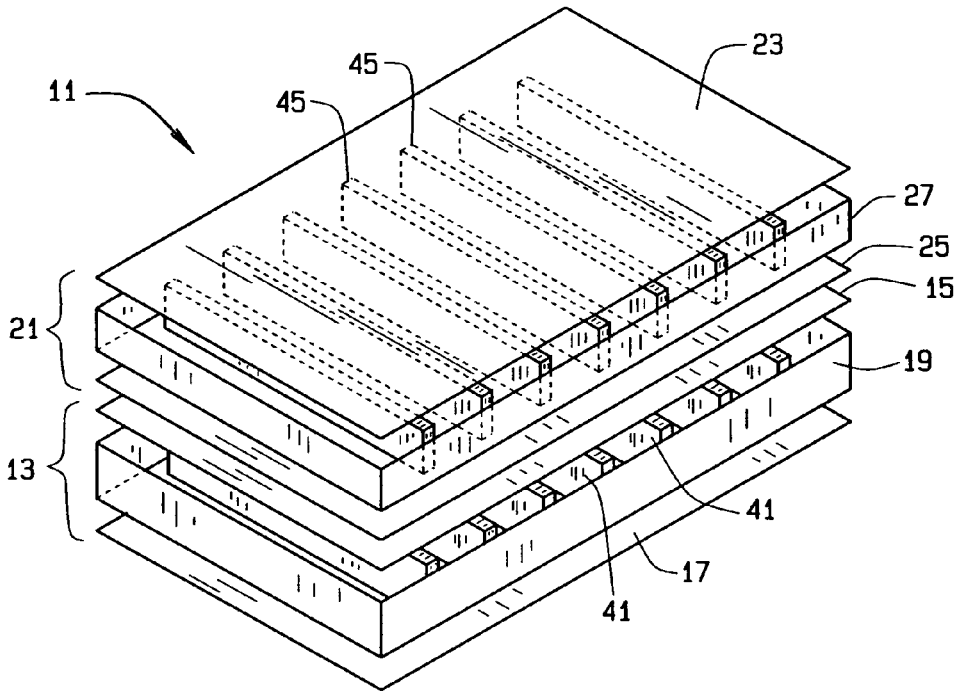
FIG. 2 is an exploded perspective view of the air mattress of FIG. 1.

Turning to the drawings and more specifically to FIGS. 1 and 2, an air mattress 11 of the present invention includes a first inflatable compartment 13 having a length and width, when inflated, sufficient to support a human body. Compartment 13 is composed of a first vinyl sheet 15 forming a top of the compartment, a second vinyl sheet 17 forming a bottom of the compartment, and a vinyl strip 19 forming the sides of the compartment. Preferably the first inflatable compartment 13 may be inflated by means of a standard inflate, or inflate/deflate, valve 20 disposed at a convenient location in the wall of compartment 13.

Figure 3:
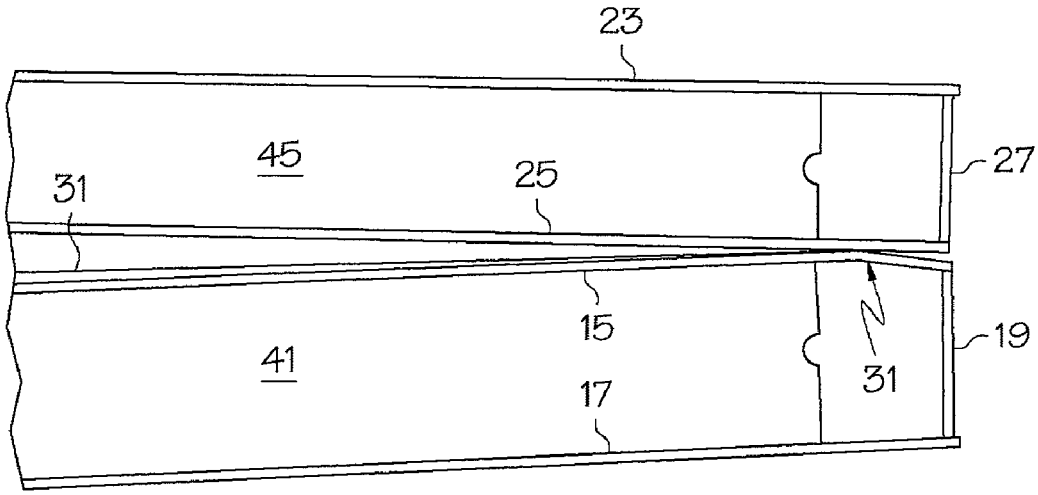
FIG. 3 is a partial sectional view, with parts broken away for clarity, of the air mattress of FIG. 1.
Figure 4:
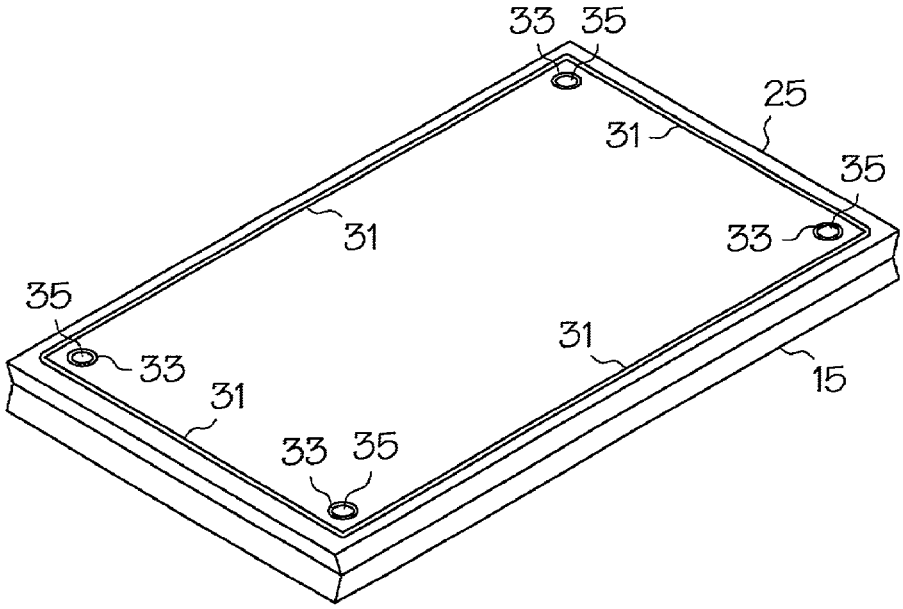
FIG. 4 is a perspective view of a portion of the air mattress of the present invention, showing the seal between the top and bottom compartments of the air mattress.

Air mattress 11 also includes a second inflatable compartment 21 disposed on the top of the first inflatable compartment 13 and secured thereto at least along a portion of the first inflatable compartment (as is shown in FIGS. 3 and 4). Second compartment 21 extends generally the length and width of the top 15 of the first compartment 13 and is of a size, when inflated, sufficient to support a human body. The second compartment 21 is composed of a first vinyl layer 23 forming the top of the second compartment, a second vinyl layer 25 forming the bottom of the second compartment, and a vinyl strip 27 forming the sides of the second compartment. The second compartment is inflatable to give the top of the air mattress a soft, pillow-like appearance and feel. It is preferred that the top of second compartment 21 include a soft, non-vinyl fabric or surface secured thereto.

FIG. 1 also shows an optional pump 28 that may be used to inflate or inflate/deflate the compartments. The pump may be attached permanently to valve 20, if desired, or may be attached temporarily to the valve by the user.

As can be seen more clearly in FIGS. 3 and 4, the first and second compartments are secured together along, but spaced inwardly from, the perimeter. This is shown most clearly in FIG. 4 where the perimeter seal is labeled 31. For example, the perimeter seal 31 may be recessed approximately one inch from the edge of the mattress. This seal connects the top vinyl layer 15 of the first compartment to the bottom vinyl layer 25 of the second compartment. In addition, the compartments are sealed together (at seals 33) adjacent a plurality of holes 35 that provide fluid communication channel connecting the first and second compartments. Of course, if desired, the first and second compartments should also be secured together at other places. The seals may be formed using any known sealing method.

It is preferred that the compartments have a single inflation/deflation valve 20, and that (in the embodiment shown in FIG. 1) the inflation air for the second compartment flow initially into the first compartment. Of course, the single inflation/deflation valve could be disposed in a wall of the second compartment instead, in which case inflating air flow would be from the second compartment to the first.

As can be seen in FIGS. 2 and 3, the vinyl layers of the first compartment are held together along the perimeter by vinyl strip 19 and internally by a plurality of spaced ribs 41. Ribs 41 are preferably formed of vinyl, extend transversely across the compartment, and are sealed to the vinyl layers of the first compartment along their length. The ribs are preferably notched on each end as shown in FIGS. 3 and terminate short of seal 31. This provides for air flow around the ribs and permits the portions of the compartments outboard of the seal 31 to flex relatively independently of each other.

Similarly, second compartment 21 includes a plurality of ribs 45 that serve the same functions for the second compartment that ribs 41 serve for the first compartment. It is preferred that first compartment 13 be somewhat taller, when inflated, than second compartment 21. For this reason, ribs 41 are preferably taller than ribs 45. For example, ribs 41 can be approximately four inches in height, while ribs 45 would be approximately three includes in height. Other dimensions could of course be used.

The construction of air mattress 11 as shown in the drawings leaves the first and second compartments substantially free to move with respect to each other except at their periphery. Specifically, sealing the compartments together substantially only along the exterior portion allows the inner portions of the compartments to move substantially with respect to one another, thereby improving the feel of the mattress. Similarly, the fact that the primary seal 31 is recessed from the periphery of the two compartments permits limited relative movement of the second compartment with respect to the first compartment along the edge of the mattress.

Figure 5A:
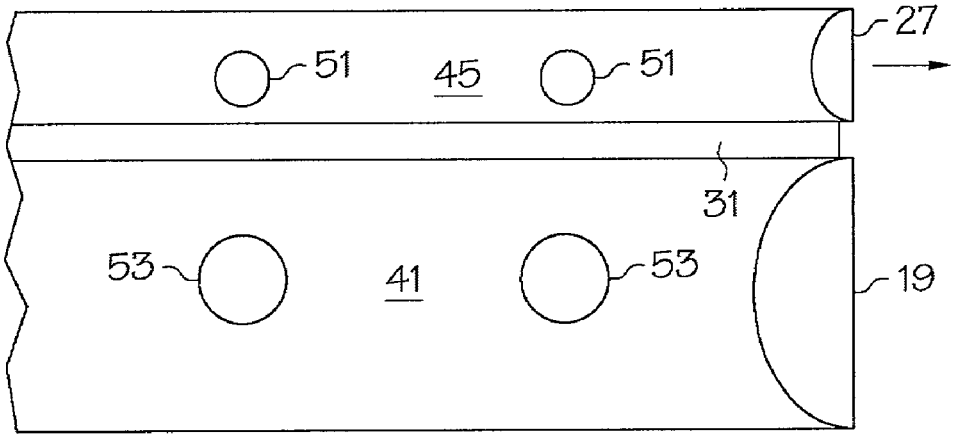
FIGS. 5A–5C show variations in the pillow top of the present invention.
Figure 5B:
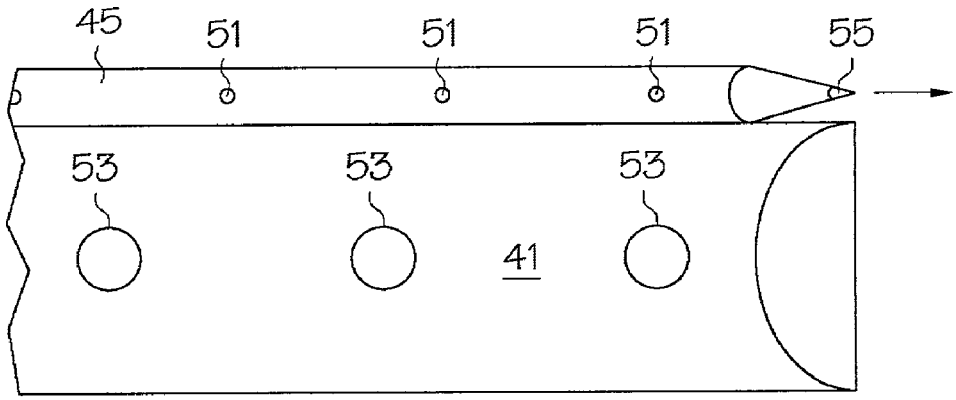
Figure 5C:
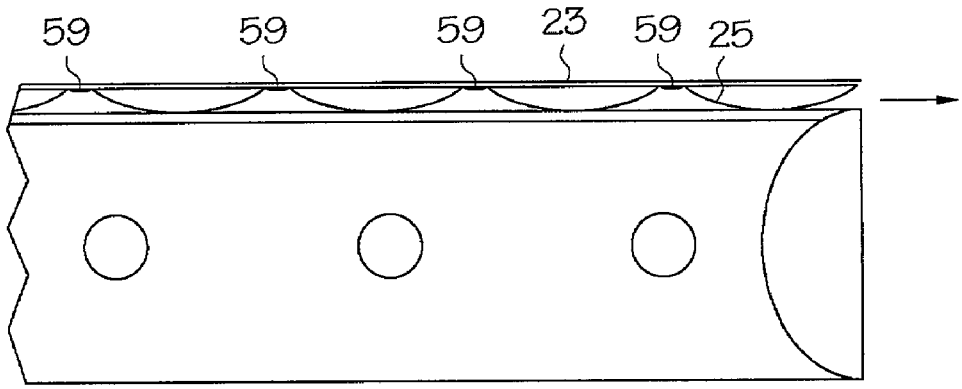

Turning to FIGS. 5A–5C, there are shown certain variations in the pillow top of the present invention. FIG. 5A illustrates in simplified form the construction of FIG. 3, with the addition of a plurality of holes 51 and 53 through ribs 45 and 41 respectively. This holes provide increased airflow back and forth in the two compartments. It should be appreciated that the second compartment in this construction has two seams and forms a gusset.

FIG. 5B illustrates a similar construction in which the top (second) compartment is constructed with a seam 55 in its vertical wall. This construction provides a more two-dimensional pillow top appearance (as opposed to the three-dimensional effect of the construction of FIG. 5A). Similarly, FIG. 5C illustrates another two-dimensional-type construction in which the top layer 23 of second compartment 21 and the bottom layer 25 of that compartment are joined together by discontinuous seals 59. For example, each seal could be a circle, or could run for only a few inches or so. Air in the second compartment in this construction flows around the seals 59. This construction provides a pleasing, tufted appearance to the pillow top of the mattress.

It should be appreciated that the air mattress of the present invention may be constructed in various sizes and shapes. It may be packaged and sold or stored in a bag, if desired.

In view of the above it will be seen that the various objects and features of the invention are achieved and other advantageous results obtained The examples contained herein are merely illustrative and are not intended in a limiting sense.

What is claimed is:

1. An air mattress comprising:

a first inflatable compartment having a length and width, when inflated, sufficient to support a human body, said compartment also having a height when inflated, said compartment having a top, a bottom, and substantially straight, vertically extending sides, said first compartment being composed of at least two layers of vinyl, one layer of vinyl forming the top of the compartment and the second forming the bottom; and a second inflatable compartment disposed on the top of the first inflatable compartment and secured thereto at least alone a portion of the first inflatable compartment at a point spaced inwardly from the sides of said first inflatable compartment, said second compartment extending generally the length and width of the top of the first compartment, said second compartment being of a size, when inflated, sufficient to support a human body, and having an inflated height substantially less than the height of the first compartment;

said second compartment being composed of at least two layers of vinyl distinct from the two layers of vinyl forming the first compartment; said second compartment being inflatable to give the top of the air mattress a soft, pillow-like appearance and feel, wherein said first compartment and said second compartment are secured together adjacent an open fluid communication channel, the fluid communication channel providing fluid communication between the first and second inflatable compartments to enable fluid in one of the first and second inflatable compartments to flow into the other of the first and second inflatable compartments, such that fluid pressure in the first and second compartments are equalized, wherein the first and second compartments are substantially free to move with respect to each other except at the periphery thereof.

2. An air mattress comprising:

a first inflatable compartment having a top, a bottom, and substantially straight, vertically extending sides and having a height when inflated, said first compartment being composed of at least two layers of material, one layer of material forming the top of the first compartment and the second layer of material forming the bottom of the first compartment;

a second inflatable compartment having a top and a bottom, the second compartment being composed of at least two layers of material, one layer of material forming the top of the second compartment, the second layer of material forming the bottom of the second compartment, the second compartment being positioned above the first compartment, said second compartment having an inflated height substantially less than the height of the first compartment;

a perimeter seal connecting the top of the first compartment to the bottom of the second compartment, the perimeter seal being spaced inwardly from the sides of the first compartment;

an open fluid communication channel providing fluid communication between the first compartment and the second compartment to enable fluid in one of the first and second inflatable compartments to flow into the other of the first and second compartments to equalize pressure in the first and second compartments; and a plurality of ribs extending between the top and bottom of one of the first and second compartments.

3. An air mattress comprising:

a first inflatable compartment having substantially straight, vertically extending sides with a length, an inflated height and a width and defining a periphery;

a second inflatable compartment extending generally the length and width of the periphery, the second inflatable compartment having a top and a bottom and an inflated height, the inflated height of the second compartment being substantially less than the height of the first compartment;

a perimeter seal connecting said first inflatable compartment to said second inflatable compartment, wherein said perimeter seal is spaced inwardly from the periphery, a plurality of ribs extending between the top and bottom of the second compartment;

an open fluid communication channel providing fluid communication between the first and second inflatable compartments to enable fluid in one of the first and second inflatable compartments to flow into the other of the first and second inflatable compartments to equalize pressure in the first and second compartments.

* * * * *

UNITED STATES PATENT AND TRADEMARK OFFICE

CERTIFICATE OF CORRECTION

PATENT NO. : 6,983,502 B2
DATED : January 10, 2006
INVENTOR(S) : Dennis Boyd

It is certified that error appears in the above-identified patent and that said Letters Patent is hereby corrected as shown below:

Column 3,
Line 66, reads "least alone a" should read -- least along a --.

Signed and Sealed this

Fourteenth Day of March, 2006

JON W. DUDAS
*Director of the United States Patent and Trademark Office*